US005291909A

United States Patent [19]

Skorman et al.

[11] Patent Number: 5,291,909

[45] Date of Patent: Mar. 8, 1994

[54] UNIVERSAL WALKER LEG SUPPORT DEVICE

[76] Inventors: Steven E. Skorman, 413 W. Warren St.; John H. Ellis, 1411 Deborah Cir., both of Shelby, N.C. 28150

[21] Appl. No.: 668,935

[22] Filed: Mar. 13, 1991

[51] Int. Cl.[5] ..... A61H 3/00

[52] U.S. Cl. ..... 135/67; 135/69; 297/5

[58] Field of Search ..... 135/65, 67-69; 297/5, 423; 272/70.3, 70.4, 114

[56] References Cited

U.S. PATENT DOCUMENTS

| | | | |
|---|---|---|---|
| 2,866,495 | 12/1958 | Diehl et al. | 135/67 X |
| 3,232,251 | 2/1966 | Hughes | 135/67 X |
| 3,443,569 | 5/1969 | Ernst | 135/68 X |
| 3,596,668 | 8/1971 | Tosto | 135/67 |
| 3,654,643 | 4/1972 | Clanan | 135/67 X |
| 4,187,869 | 2/1980 | Marchetti | 135/68 X |
| 4,722,356 | 2/1988 | Rehder | 135/67 |

FOREIGN PATENT DOCUMENTS

| | | | |
|---|---|---|---|
| 544730 | 8/1957 | Canada | 135/69 |
| 2255881 | 7/1975 | France | 135/67 |
| 2185716 | 7/1987 | United Kingdom | 135/67 |

*Primary Examiner*—Carl D. Friedman
*Assistant Examiner*—Lan C. Mai
*Attorney, Agent, or Firm*—Shefte, Pinckney & Sawyer

[57] ABSTRACT

A leg support device for an invalid walker of the type having an upright frame structure with handle portions positioned so as to be gripped by the user when standing or walking and having a plurality of downwardly projecting legs, such leg support device being selectively mountable in a variety of vertically related positions to accommodate the physical requirements of the user and capable of achieving a variety of structural configurations so that the leg support device may be mounted to a variety of invalid walkers having different angular orientations between the legs and having different distances between the legs.

9 Claims, 4 Drawing Sheets

UNIVERSAL WALKER LEG SUPPORT DEVICE

BACKGROUND OF THE INVENTION

The present invention relates broadly to ambulatory aids for disabled, post-operative or injured people who need additional support and stability in moving about or standing, and more particularly, to an invalid walker and a leg or leg support device mountable thereon. Such devices are generally referred to herein by the term leg support device, but it is expressly understood that such term includes devices used to support the leg, foot, and ankle of the user. Currently, invalid walkers generally have an upright frame structure with four downwardly projecting legs, and on the upper portion of the frame structure, handles are provided for gripping by the user. The user stands within the confines of the frame structure, gripping the handle portions, so as to utilize the frame structure for support and stability while standing or walking.

Typical invalid walkers require the user to support himself or herself solely by the gripping handles utilizing the user's arms. Problems arise with amputees or persons with leg, ankle, or foot injuries who must support the injured area with the upper torso, allowing the affected leg to hang free. Generally, when a leg support device has been offered, it has been offered in a fixed position, restricting its use and the walker to which it is applied. The aforementioned amputees or disabled persons with leg, ankle, or foot injuries could easily be faced with a leg support device that is worse than no support device at all, as for example where it is located at a disadvantageous position, causing either discomfort or impossibility of use due to its fixed mounting position.

For example, Tosto, U.S. Pat. No. 3,596,668, discloses a leg support device mounted in the open frame structure of an invalid walker. The leg support of Tosto, however, is mounted to two cross-members in the walker frame and is thereby effectively in a fixed position relative to the cross member of the walker frame. The leg support device of Tosto is incapable of height adjustability, and it does not readily adapt itself for use with a variety of walkers having different frame and leg construction.

Moreover, if a person were in temporary need of additional leg support and utilized the walker with the leg support device fixed in position, once the need passed, the user would be forced to change walkers. Conversely, if the user of a walker suddenly required leg support, that user would again be forced to change walkers. Further, suppliers of invalid walkers would have to keep two kinds of walkers; those with leg supports and those without leg supports to satisfy the demand for each type.

SUMMARY OF THE INVENTION

It is accordingly an object of the present invention to provide a leg support device that is selectively and adjustably mountable on an invalid walker so as to provide selective vertical adjustment of the leg support device to satisfy the physical requirements of the user as well as selective mountability allowing mounting of the leg support device on a variety of invalid walkers with differing leg arrangements.

The leg support device of the present invention is primarily adapted for invalid walkers of the type having an upright frame structure with handle portions positioned so as to be gripped by the user when standing or walking and having a plurality of downwardly projecting legs which provide support and stability of movement for disabled persons. Basically, the leg support device comprises a generally horizontally oriented platform, preferably cushioned, in an arrangement for selectively mounting the leg support device to the walker at any one of a plurality of vertical positions according to the user's physical requirements, and an arrangement for selectively adjusting the configuration of the leg support device so that it can be mounted on a variety of conventional invalid walkers with varying leg arrangements.

According to one aspect of the present invention, the leg support device has an arrangement for selectively mounting the leg support device to the walker legs at any one of a multiplicity of predetermined positions located in spaced vertical relation to one another with the leg support device disposed generally horizontally in each of the positions, so that the vertical position of the leg support device can be adjusted according to the physical requirements of the user.

In the preferred embodiment of the present invention, the arrangement for selectively mounting the leg support device to the walker legs includes at least one vertically oriented L-shaped angle. A plurality of holes is formed therein and arranged along the length of the L-shaped angle so that the leg support device can be selectively positioned at any one of a multiplicity of predetermined vertically related positions at which at least one of the holes in the L-shaped angle is in alignment with the hole in the adjacent walker leg. The mounting arrangement also includes a bolt arrangement for selectively mounting the L-shaped angle to the leg by being passed through the adjacent hole, which provides selective adjustment of the leg support according to the physical requirements of the user.

According to another aspect of the present invention, a leg support device includes an assembly for selectively changing the structural configuration of the leg support device in order to selectively mount the leg support device on a multiplicity of invalid walkers with different leg arrangements. Within this assembly are included an arrangement for selectively varying the effective length of the platform of the leg support device so that the leg support device may be selectively mounted on a multiplicity of invalid walkers having different dimensions between the legs thereof, and a hinge arrangement associated with the platform for selectively mounting the leg support device on a multiplicity of walkers having different angular relationships between at least two of the legs thereof.

According to the preferred embodiment of the present invention, the arrangement for selectively varying the effective length of the platform includes at least one platform support plate and an arrangement for mounting the support plate to the platform to permit selective horizontal movement of the support plate relative to the platform which increases and decreases the effective length of the platform of the leg support device so that it may be mounted on a multiplicity of different walker having varying dimensions between at least two of the downwardly projecting legs.

Preferably, the assembly for selectively changing the structural configuration of the leg support device includes at least one vertically oriented support plate mounted onto the platform mounting plate with a hinge assembly. A first hinge portion is mounted onto the generally horizontally oriented platform support plate, while a second portion is mounted onto the vertical support plate, so that selective angular orientations between the platform support plate and the vertical support plate of between 0° and 180° may be achieved. Thus, the leg support device may be mounted to a multiplicity of invalid walkers having the legs projecting downwardly at different angular orientations.

DESCRIPTION OF THE PREFERRED EMBODIMENT

Figure 1:
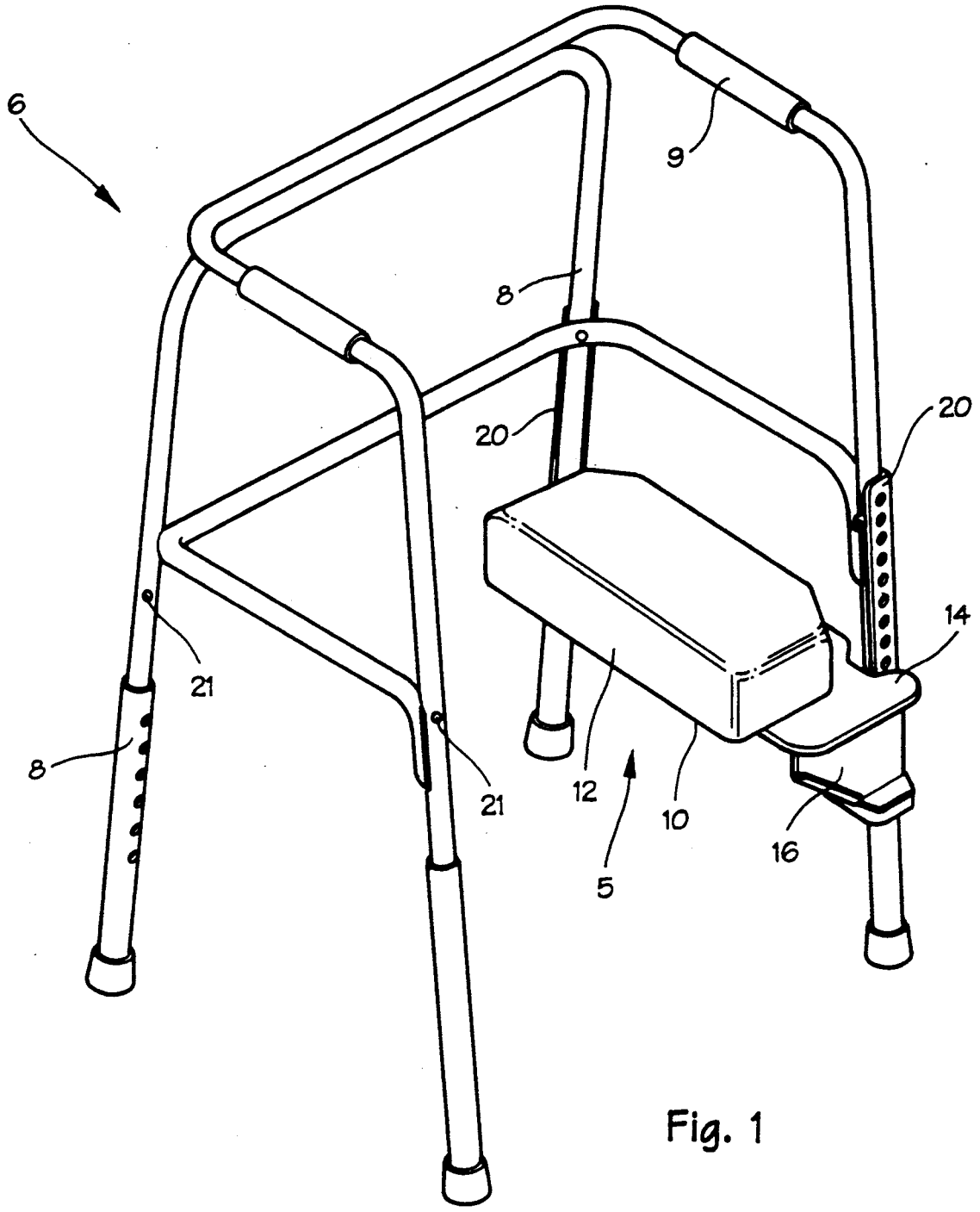
FIG. 1 is a perspective view of the leg support device according to the preferred embodiment of the present invention, and mounted to an invalid walker.

Looking now in greater detail at the accompanying drawings, and particularly at FIG. 1, a leg support device according to the preferred embodiment of the present invention is illustrated and indicated generally at 5, and is mounted on a typical invalid walker 6 which includes an upright frame structure having handle portions 9 positioned so as to be gripped by the user, and a plurality of downwardly projecting legs 8. The leg support device basically includes a platform 10, on which a cushion 12 is supported, two platform mounting plates 14 mounted on the platform 10, two corresponding vertical support plates 16 mounted on the platform mounting plates 14, and a vertically-oriented L-shaped angle 20 for mounting the leg support device 5 onto the legs 8 of the walker 6.

Figure 2:
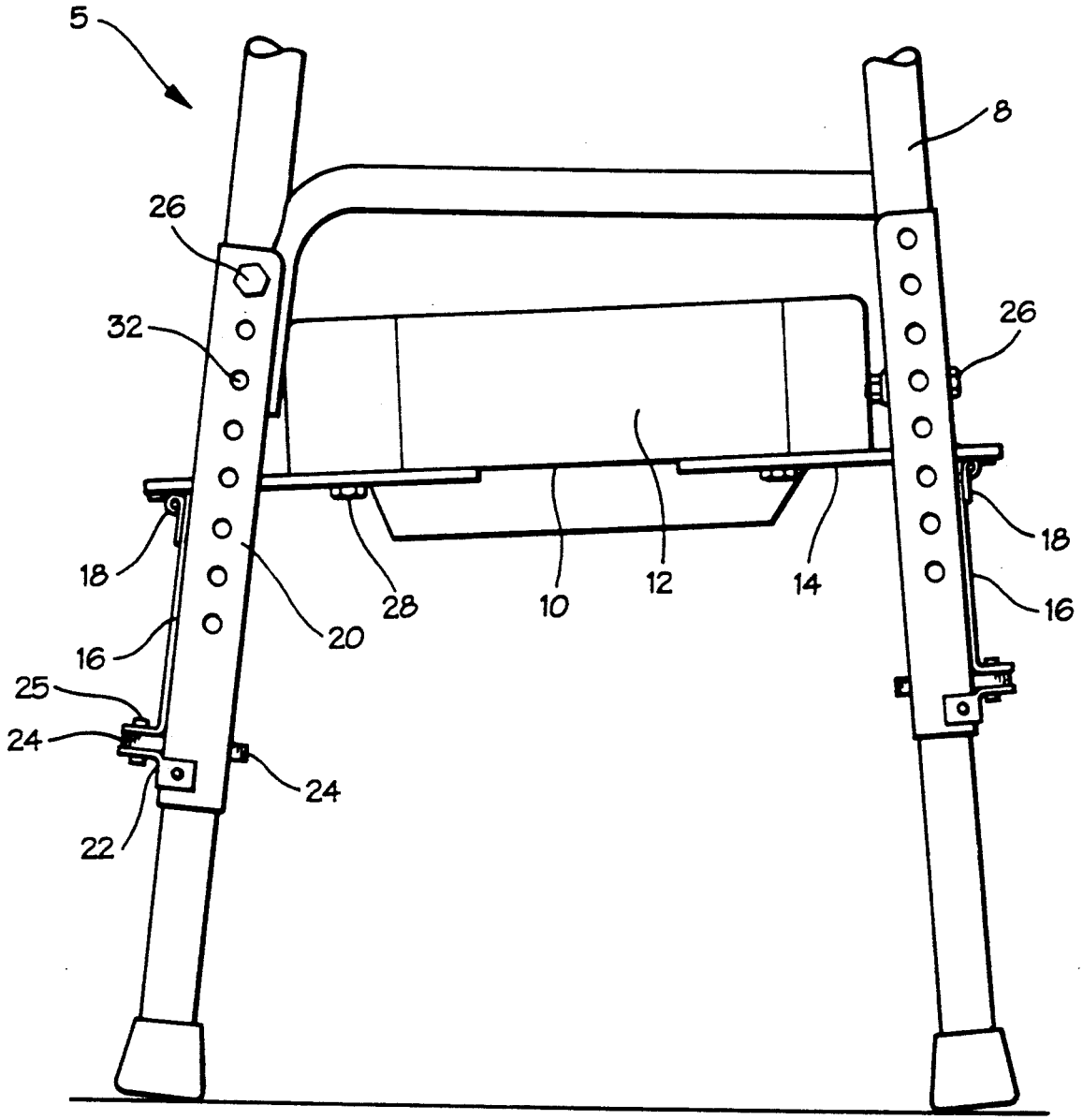
FIG. 2 is a side view of a leg support device illustrated in FIG. 1.
Figure 3:
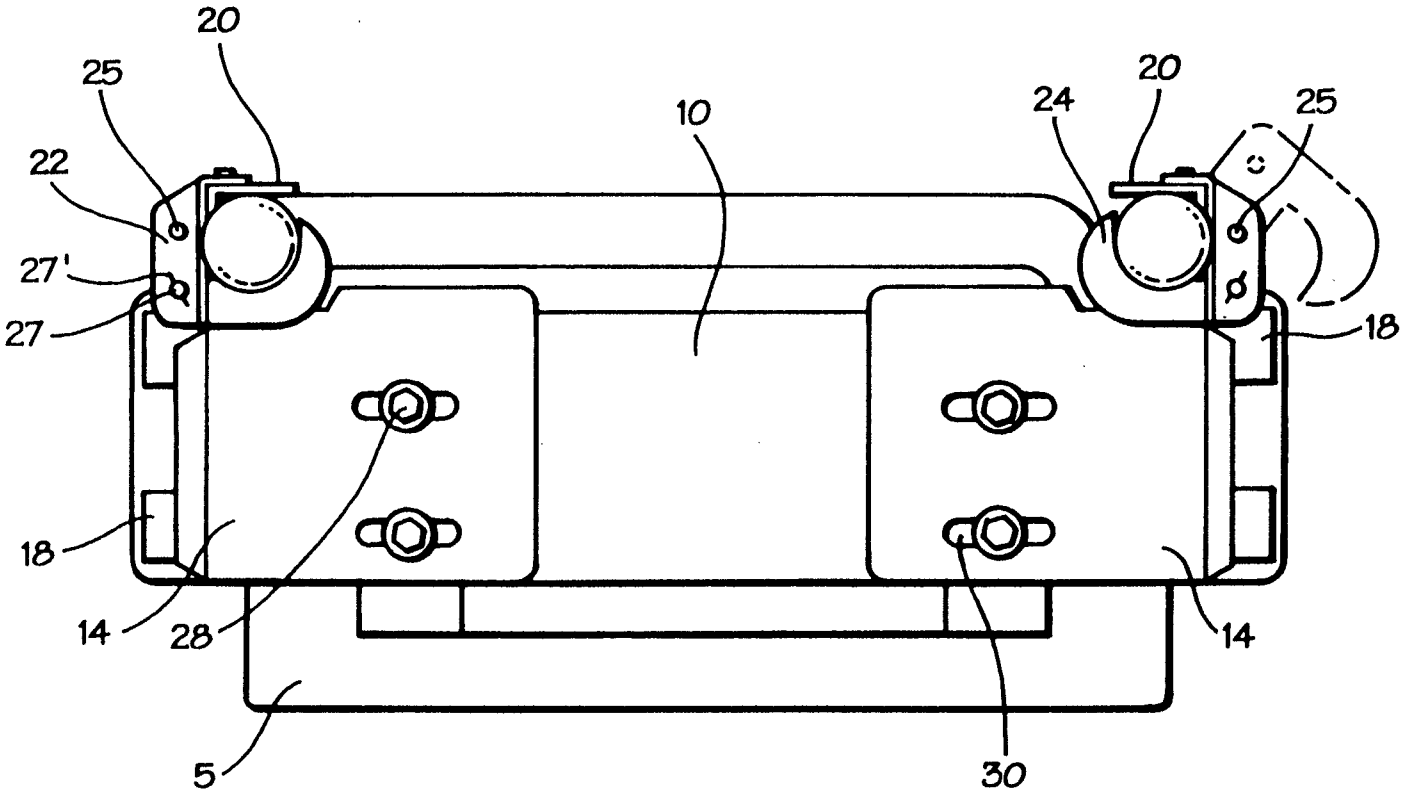
FIG. 3 is a bottom view of the leg support device illustrated in FIG. 2.

As best seen in FIGS. 2 and 3, each of the two platform mounting plates 14 are formed with parallel slots 30, each of which receives a bolt 28 that extends therethrough and is threadably received by the platform 10. Looking at FIG. 3, it will be apparent that one or both of the platform mounting plates 14 can move relative to the platform 10 by loosening bolts 28, sliding the platform mounting plates 14 relative to the platform 10, and then retightening the bolts 28

Figure 4:
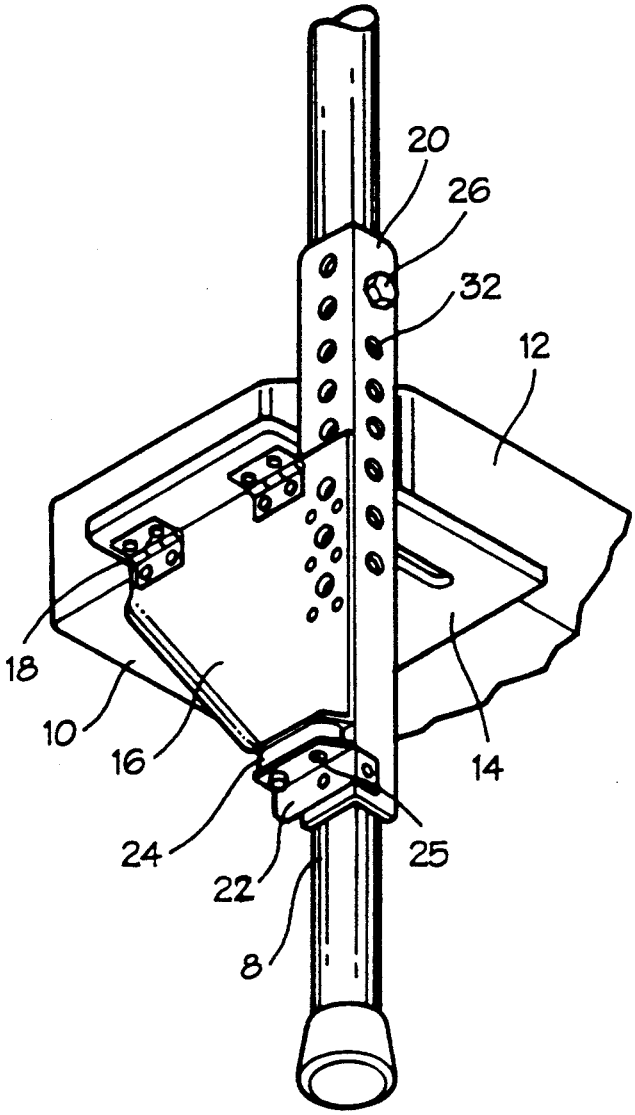
FIG. 4 is perspective view of the leg support device shown in FIG. 3 illustrating the mounting arrangement thereof.

As best seen in FIGS. 2 and 4, one of the vertical support plates 16 is mounted at the extending end of each of the platform mounting plates 14 by hinges 18, each of the hinges 18 having a first portion that is secured to the platform mounting plates 14 and another portion attached to the vertical support plates 16 whereby the hinges 18 permit relative angular movement of the vertical support plates 16 through a range 0° to 180°. Each of the vertical support plates 16 is fixed to one of the L-shaped angle members 20, preferably by rivets or the like, and as best seen in FIGS. 2 and 4, a hook-shaped latch clip 24 is pivotally mounted between an outwardly projecting shoulder at the bottom end of the vertical support plate 16 and a latch plate 22 fixed to the lower end of the L-shaped angle 20, such pivotal mounting including a pivot pin 25 that extends through the aforesaid outwardly projecting shoulder, the latch clip 24, and the latch plate 22. As illustrated in FIG. 3, and as will be described in greater detail presently, the latch clip 24 can be pivoted about pivot pin 25 between an open position which is shown in dotted lines in FIG. 3, and a closed position engaging one of the legs 8 of the walker 6 as shown in full lines in FIG. 3. A removable pin 27 having a cotter pin 27' therein is provided for insertion through holes in the outwardly extending shoulder, the latch plate clip 24, and the latch plate 22 which correspond to one another when the latch clip 24 is at its closed or leg-engaging position.

Each of the two vertically-oriented L-shaped angles 20 is formed with a plurality of holes or apertures 32 that are vertically spaced from one another along the vertically extending length of the angles 20, and the upper ends of the angles 20 are mounted to a front and back leg 8 on one side of the walker 6 by a nut and bolt arrangement 26 that extends through an aperture 32 in the angle 20 and through a conveniently placed hole 21 in each of the two legs 8. While the nut and bolt arrangement 26 is the preferred means for attaching the angles 20 to the legs 8, it will of course be understood that other known attachment devices, such as clamps, could also be used for this purpose.

In use, the typical walker 6 will usually include conventional telescopic leg portions 8' having a conventional hole and pin arrangement by which the effective height of the walker can be adjusted to properly position the handle portions 9 of the walker at a correct vertical height for the particular individual who is to use the walker. In accordance with the present invention, the leg support device 5 may then be mounted on the walker 6 between a front and a back leg 8 on one side of the walker 6, and while FIG. 1 shows the leg support device 5 mounted on one side of the walker 6, it will be appreciated that it can readily be mounted on the two legs 8 on the other side of the walker 6, if desired.

It will be apparent that the unique construction of the leg support device 5 of the present invention permits it not only to be mounted at virtually any number of different vertical positions on the legs 8 of the walker 6, its overall structural configuration can be selectively adjusted so that the leg support device 5 can be mounted to virtually any conventional or typical walker 6 regardless of the difference in spacing between the leg of such walkers or the difference in the angular orientation of such legs 8. More specifically, to mount the leg support device 5 to the legs 8 of the walker 6, the latch clips 24 on each of the angles 20 are pivoted outwardly to their respective open positions, and the bolts 28 are slightly loosened so that the platform mounting plates 14 can be moved inwardly or outwardly with respect to the platform 10. The two angles 20 are then positioned about the two legs 8, respectively, and the angles 20 are then moved vertically with respect to the legs 8 until one of the apertures 32 in each angle 20 coincides with the hole 8 in the adjacent leg at a desired height that corresponds to the specific physical requirements of the particular user for the walker 6, namely the vertical height at which the bent leg of the particular user is most comfortably situated on the cushion 12 of the platform 10.

It is significant to note that the relative movement of the platform mounting plates 14 with respect to the platform 10 permits the effective length of the leg support device 5 to be varied to an extent that it will fit between legs 8 of different walkers having different distances between the front and back legs thereof. Moreover, since the front and back legs of most walkers do not extend in parallel relation to one another, the selective adjustment of the effective length of the leg support device 5 of the present invention also permits the leg support device 5 to be mounted at different vertical positions on the legs 8 even though the distance between the legs 8 gradually increases from top to bottom as illustrated by the typical walker 6 shown in FIG. 2.

It is also to be noted that the hinges 18 permit the vertical support plates 16 to pivot inwardly or outwardly about the platform mounting plates 14 so that the angles 20, which are secured to the vertical support plates 16, can assume any angular orientation that is necessary for the angles 20 to coincide exactly with the angular orientation of the two legs 8.

After the angles 20 are positioned at the desired adjusted position for the particular user utilizing the above-described adjustable configuration of the leg support device 5 of the present invention, the bolts 26 are inserted through the holes 32 of the angle 20 and the legs 8 which coincide with one another to secure the upper end of the angle 20 to the legs 8, and the latch clips 24 are pivoted inwardly to their closed positions to firmly engage the legs 8 as best seen in FIG. 3. The bolts 28 are then retightened, and the leg support device 5 is then securely mounted between the two legs 8 at the particular adjusted vertical position which is most comfortable for the particular user of the walker 6.

It will be appreciated from the above that the leg support device 5 is easily adjustable to any one of a number of vertical positions on any given walker 6, and the leg support device 5 may also be adjustably mounted on any one of a wide variety of different walkers having different leg spacings and different angular leg orientations. The latter advantage of the present invention is particularly significant in situations where doctors or other medical care providers may wish to maintain an inventory of leg support devices that can be provided to patients on a temporary basis for use on that patent's particular walker, and in commercial establishments which rent walkers, because it will now be possible to also rent leg support devices that can be used with a variety of different walkers normally maintained in inventory by such establishments, or which can be used with a wide variety of walkers that are already owned by the patients.

Finally, a walker made according to the present invention, with its readily adjustable leg support device, offers to the user a significant degree of independence in that the user can move about relatively freely and can perform a number of tasks, all without any assistance from others.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An adjustable leg support device configured for mounting on a variety of invalid walkers of the general type having an upright frame structure with handle portions positioned so as to be gripped by the user when standing or walking and having a plurality of downwardly projecting legs which provide support and stability of movement for disabled persons, said leg support device comprising means for supporting an injured leg, ankle, or foot of the user for added comfort and stability during movement or while standing at rest, said leg support device having means for selectively mounting said leg support device on said walker legs at any one of a multiplicity of predetermined positions located in spaced vertical relation to one another with said leg support being disposed generally horizontally at each said position whereby the vertical position of the leg support device can be adjusted according to the physical requirements of the user, and means for selectively changing the structural configuration of said leg support device including a platform support plate and at least one vertically oriented support plate mounted to said platform support plate with hinge means, said hinge means including a first hinge portion mounted on said vertically oriented support plate and a second hinge portion mounted onto said platform support plate, said hinge means providing selective angular orientation between said platform support plate and said vertical support plate of between 0° and 180°, thereby permitting selective mounting of said leg support device to a multiplicity of invalid walkers having said legs projecting downwardly at different angular orientations.

2. An adjustable leg support device according to claim 1 and characterized further in that said leg support device includes a platform on which the user can rest an injured or operated-upon leg, ankle, or foot, said platform having a cushion mounted thereonto for enhanced user comfort.

3. An adjustable leg support device according to claim 1 for use with said walker in which at least two legs have holes therein, and characterized further in that said means for selectively mounting said leg support device to said walker includes at least one vertically oriented angle formed with a plurality of vertically-spaced holes arranged along the length of said angle so that said leg support device can be selectively positioned at any one of said multiplicity of predetermined vertically related positions at which at least one of said holes in said is adjacent to at least one of said holes in said leg, and bolt means for selectively mounting said angle to said legs by being passed through said adjacent holes.

4. An adjustable leg support device configured for selectively mounting on a variety of invalid walkers of the general type having an upright frame structure with handle portions positioned so as to be gripped by the user when standing or walking and having a plurality of downwardly projecting legs which provide support and stability of movement for disabled persons, said leg support device comprising means for supporting an injured or operated-upon leg, ankle, or foot of the user for added comfort and stability during movement or while standing at rest, and means for selectively changing the structural configuration of said leg support device in order to selectively mount said leg support device on the legs of a multiplicity of invalid walkers having different leg arrangements, said means for selectively changing the structural configuration of said leg support device including means for increasing or decreasing the effective length of said leg support device whereby said leg support device can be mounted on a plurality of different invalid walkers having varying dimensions between at least two of said downwardly projecting legs, and mounting means permitting selective mounting of said leg support device to a multiplicity of invalid walkers having said legs projecting downwardly at different angular orientations.

5. An adjustable leg support device according to claim 4 and characterized further in that said leg support device includes a generally horizonal platform on which the user can rest an injured or operated-upon leg, ankle, or foot, said platform having a cushion mounted thereonto for enhanced user comfort.

6. An adjustable leg support device according to claim 4 for use on said invalid walker in which at least two legs have holes therein and characterized further in that said leg support device includes at least one vertically oriented angle formed with a plurality of vertically spaced holes arranged along the length of said angle so that said leg support device can be selectively positioned at any one of a multiplicity of predetermined vertically related positions at which at least one of said holes in said angle is adjacent to at least one of said holes in said leg, and in that bolt means is provided for selectively mounting said angle to said leg by being passed through said adjacent holes thereby providing selective adjustment of said leg support device according to the physical requirements of the user.

7. An adjustable leg support device according to claim 6 and characterized further in that said means for selectively changing the structural configuration of said leg support device includes at least one support plate and means for mounting said support plate to said platform to permit selective horizonal movement of said support device relative to said platform to increase or decrease the effective length of said leg support device whereby said leg support device can be mounted on a plurality of different invalid walkers having varying dimensions between at least two of said downwardly projecting legs.

8. An adjustable leg support device according to claim 7 and characterized further in that said means for selectively changing the structural configuration of said leg support device includes at least one vertically oriented support plate mounted to said platform support plate with hinge means, said hinge means including a first hinge portion mounted on said vertically oriented support plate and a second hinge portion mounted onto said platform support plate, said hinge means providing selective angular orientations between said platform support plate and said vertical support plate of between 0° and 180°, thereby permitting selective mounting of said leg support device to a multiplicity of invalid walkers having said legs projecting downwardly at different angular orientations.

9. An adjustable leg support device for an invalid walker of the type having an upright frame structure with handle portions positioned so as to be gripped by the user when standing or walking and having a plurality of downwardly projecting legs which have holes therein and which provide support and stability of movement for disabled persons, said leg support device comprising:

a) means for supporting an injured leg, ankle, or foot of the user for added comfort and stability during movement or while at rest, including a platform on which the user can rest and support a leg, ankle, or foot, said platform having a cushion mounted thereonto for enhanced user comfort;

b) means for selectively mounting said leg support device on said walker including:

i) at least one vertically oriented angle formed with a plurality of vertically-spaced holes arranged along the length of said angle so that said leg support device can be selectively positioned at any one of a multiplicity of vertically related positions at which at least one of said holes in said angle is adjacent at least one of said holes in said leg, and bolt means for selectively mounting said angle to said legs by being passed through said adjacent holes thereby providing selective vertical adjustment of said leg support device according to the physical requirements of the user;

ii) means for selectively changing the effective length of said leg support device including at least one support plate and means for mounting said support plate to said platform to permit selective horizontal movement of said support device relative to said platform to increase or decrease the effective length of said leg support device whereby said leg support device can be mounted on a plurality of different invalid walkers having varying dimensions between at least two of said downwardly projecting legs; and iii) means for selectively changing the angular orientation of said leg support device including at least one vertically oriented support plate mounted to said platform support plate with hinge means having a first hinge portion mounted onto said platform support plate and a second hinge portion mounted onto said vertically oriented support plate, said hinge means providing selective angular adjustments between said platform support plate and said vertically oriented support plate of between 0° and 180°, thereby providing selective mounting of said leg support device to a multiplicity of invalid walkers having said legs projecting downwardly at different angular orientations.

* * * * *